US006413367B1

(12) United States Patent
Svedman et al.

(10) Patent No.: US 6,413,367 B1
(45) Date of Patent: Jul. 2, 2002

(54) TREATMENT OF CELLULOSIC MATERIAL WITH A CHELATING AGENT PRIOR TO ALKALINE DELIGNIFICATION

(75) Inventors: Mikael Svedman, Rauma; Thomas Fant, Böle; Seppo Martikainen, Kallaanvaara, all of (FI)

(73) Assignee: Valmet Chemical Pulping OY, Pori (FI)

( * ) Notice: Subject to any disclaimer, the term of this patent is extended or adjusted under 35 U.S.C. 154(b) by 0 days.

(21) Appl. No.: 09/830,925

(22) PCT Filed: Oct. 27, 1999

(86) PCT No.: PCT/FI99/00901

§ 371 (c)(1),
(2), (4) Date: Aug. 3, 2001

(87) PCT Pub. No.: WO00/28133

PCT Pub. Date: May 18, 2000

(30) Foreign Application Priority Data

Nov. 6, 1998 (FI) ..... 982411

(51) Int. Cl.[7] ..... D21C 1/02

(52) U.S. Cl. ..... 162/68; 162/41; 162/76; 162/90

(58) Field of Search ..... 162/63, 76, 81, 162/90, 68

(56) References Cited

U.S. PATENT DOCUMENTS

| | | | | |
|---|---|---|---|---|
| 4,599,138 A | | 7/1986 | Lindahl | |
| 4,826,567 A | | 5/1989 | Gratzl | |
| 5,002,635 A | * | 3/1991 | Gentile, Jr. et al. | 162/76 |
| 5,593,544 A | | 1/1997 | Fahlgren et al. | |

FOREIGN PATENT DOCUMENTS

| | | |
|---|---|---|
| SE | 9402229 | 12/1995 |
| WO | WO 95/02796 A1 | 1/1995 |

OTHER PUBLICATIONS

Bryant et al., "Manganese Removal in Closed Kraft Mill Bleach Plants," *Tappi Journal*, Pulp Bleaching, vol. 77, No. 2, pp. 137–148 (1993).

* cited by examiner

*Primary Examiner*—Dean T. Nguyen
(74) *Attorney, Agent, or Firm*—Burns, Doane, Swecker & Mathis, LLP

(57) ABSTRACT

A process for the production of pulp using alkaline delignification is disclosed, wherein cellulosic material is initially treated with steam, and a chelating agent is added in connection with the steam treatment. The end pH of the steam treatment stage is below 5. Liquors containing chelated, so-called non-process compounds are not recycled in the pulping process, but expelled therefrom for further processing where non-process compounds are eliminated.

24 Claims, 1 Drawing Sheet

TREATMENT OF CELLULOSIC MATERIAL WITH A CHELATING AGENT PRIOR TO ALKALINE DELIGNIFICATION

FIELD OF THE INVENTION

The present invention relates to a process for the production of pulp from lignocelfulose-containing material. More particularly, the present invention relates to processes for preparing pulp, in which processes wood chips or similar lignocellulosic material is treated with steam for packing and for removing gases therein, whereby measures for removal of so-called non-process compounds are taken during the steaming step.

BACKGROUND OF THE INVENTION

Throughout this disclosure, the term "alkaline cooking" refers to pulp manufacturing processes well known in the art as draft cooking, soda cooking and soda anthraquinone cooking, as well as to cooking processes involving organic solvents, which include alkaline steps.

All lignin-containing cellulosic materials in nature contain a wide variety of organic and inorganic compounds beside the main components, lignin and cellulose. Unavoidably, these so-called non-process compounds enter the pulping process and will be subjected to the same chemical and physical treatment as the desired compounds. This is particularly. true in the case of alkaline delignification processes, such as kraft and soda cooking, which do not remove, for example, metal ions from the processed material. Traditionally, the non-process compounds have been led to the combustion and recovery line of the pulp mill with the spent liquor, or they have been ousted together with pulp mill effluents. Only some compounds have been separated and sold as by-products, such as sugars, tall oil and turpentine. Under the conventional circumstances of distribution of these compounds in a pulp mill process system, conventional pulping technology has been able to cope with the arising problems, such as foaming, deposits and higher consumption of bleaching chemicals, just to mention a few from the extensive list of common difficulties in plant operation.

Metals entering the process include all those occurring naturally in raw materials: Monovalent metals sodium and potassium, earth-alkali divalent metals calcium, magnesium and barium, and heavy metals such as iron, copper and manganese. Under alkaline conditions, metal ions are retained in the pulp and cause a lot of harm making the bleaching by oxygen chemicals (especially by hydrogen peroxide) less effective, resulting in deteriorated pulp strength and excess chemical consumption. In addition, metals, especially divalent metals as calcium, tend to form precipitated deposits in process machinery, thus compromising operational efficiency. Currently, the metal problem is coped with by washing the metals to effluents after an acidic bleaching stage, or chelating metals in separate so-called Q stages before peroxide bleaching stages. Once the metals are in the pulp mill cycle, they are difficult to remove. In practice, the concentrations will increase to reach an equilibrium between dissolution and precipitation, and some precipitates are removed in the filtration of cooking liquors. It is clear that any process for removal of metals prior to their entering the pulp mill cycle would greatly improve the situation.

As set forth above, under conventional conditions of non-process compound distribution in a pulp mill process system, the problems caused by these agents have been overcome by means of conventional pulping technology. However, contemporary pulping is developing nm a very demanding direction: towards a closed-cycle pulp mill. Ultimately, this means no effluents at all: the mill will recycle its own process water, which flows counter-currently to the pulping process. On the way towards the zero-effluent pulp mill by reducing the wastewater amount, the industry has faced severe problems caused by the accumulation of non-process compounds in the processes. Various process internal measures and technologies have been proposed and applied to cope with undesired, accumulating agents. Typical for most prior art measures is that they are applied process-internally, i.e. in the middle of the fiber line, after the non-process compounds have entered the more or less closed process. Acidic stages and Q-stages have been introduced in bleaching. Encountered problems are high cost, effluents, environmental concerns because of low biodegradability, and adverse effects in the effluent treatment process.

As used hereinafter, "chelant" or "chelating agent" refers to a compound that owns ability to form complexes, so called chelates, with metals occurring in fiber raw material. Typically, chelants are non-nitrogenous polycarboxylic acids or nitrogenous polyaminocarboxylic acids.

To remove metals prior to alkaline cooking, an extra chelation step involving chelant-containing liquor has been proposed at pH levels above 5, in International Patent Application WO95/02796. However, relative to prior art processes, this process requires both an additional immersion step and additional equipment. Also proposed is chelation performed simultaneously with an alkaline impregnation step, but in such a case the pH level is normally above 12, which makes the chelation ineffective (Bryant P. S. and Edwards L. L., Tappi Journal 77(2):137–148 (1994)).

Swedish Patent application 9402229 (Stora Kopparbergs Bergslags Ab) discloses a method for removal of transition metals from cellulose pulp, wherein pulp raw material is impregnated and/or cooked, and the chelant is added in one or several steps to the pulp raw material and/or during the cooking process. Preferred pH values are above 7, which is not advantageous for dissolution of metals and chelating. Chelates may cause difficulties if retained in liquors that are to be reused in subsequent batches or recycled to the beginning of the process.

Steam packing is commonly used in the chip filling stage of batch digesters to enhance is packing of wood, to pre-heat and soften chips and to evacuate air from the digester and from incoming wood through the screens of the digester using a fan. Alternatively, steam can also be added to, for example, a chip bin operating as a surge bin between the woodyard and the batch digester to preheat chips and remove air from the incoming wood. Steam is further used for so-called prehydrolysis cooking to subject the lignocellulosic material to acidic hydrolysis before cooking. The objective of prehydrolysis processes is to remove as much hemicellulose as possible from the cellulose matrix, which task the alkaline cooking process can not accomplish. This is done in order to prepare pulp for products based on chemically modified cellulose such as viscose and cellulose acetate, and other derivatives which cannot be manufactured in the presence of hemicelluloses.

Steaming of chips is also used prior to continuous cooking. A pre-steaming vessel performs critical functions: it is a surge bin which provides volumetric capacity between the woodyard and the digester feed system; it is a heat recovery unit for preheating chips using reused, so-called flash steam from the cooking liquor leaving the cooking unit; and it is the site of a separation process which removes air from the incoming wood. However, steaming as such does not remove metals from wood.

SUMMARY OF THE INVENTION

According to the present invention, as defined by claim 1, non-process compounds as defined above are prevented from entering the fiber line by means of chelating in a steaming stage, and expelling the chelates formed from the process prior to delignification.

One objective of the present invention is to provide an improved alkaline delignification process for the preparation of pulp to be bleached and to be carried out within the frame-work of a modern, closed-cycle pulp mill to meet present requirements for pulp purity after the cooking stage.

A process according to the present invention comprises chelant addition during a steam pretreatment stage for the liberation of metals under acidic conditions with subsequent chelation, and a subsequent change of the acid conditions of the lignocellulosic material with neutral or alkaline cooking liquors. As the chelate-containing liquor is thereafter removed from the digester and sent to the chemicals recovery cycle without being reused at any stage in the cooking process, accumulation of non-process compounds is effectively avoided. After delignification, pulp suitable for bleaching to paper pulp or dissolving pulp is obtained.

For the desired removal of metals from the lignocellulosic material, it is essential to add chelating agents to arrive at an acidic end-pH level below 5 accomplished during steaming, before introducing neutralizing cooking liquors. A low end-pH as indicated leads to effective dissolution of metals from the lignocellulosic material, and added chelants keep the metals in solution when neutral or alkaline cooking liquors are introduced. By this process, resorption of metals to the pulp material is avoided. In this context, end pH means the pH inside the chips or the pH of the condensate pressed out from the steamed chips. It is also essential that after filling the digester with alkaline liquor, which brings the chelates into the liquor, the alkaline liquor is removed with another liquor, whereby the removed liquor is directed to the plant's recovery cycle without being reused prior or during delignifying the cellulosic material.

According to one embodiment of the present invention, chelant is added to lignocellulosic material separately or in the steam flow in an associated steam treatment in an early stage of a batch pulping process, at a desired steam temperature, preferably from about 80 to about 185° C., more preferably from about 95 to about 170° C., during a time sufficient for reaching an end pH below about 5.

According to another embodiment of the present invention, chelant is added to lignocellulosic material separately or in the steam flow in an associated steam treatment in a vessel outside a batch digester at a desired steam temperature, preferably from about 80 to about 185° C., more preferably from about 95 to about 170° C., during a time sufficient for reaching an end pH of below about 5.

According to another embodiment of the present invention, chelant is added to lignocellulosic material separately or in the steam flow in an associated steam treatment in an early stage of a batch pulping process, at a desired steam temperature, during a time sufficient for reaching an end pH of below about 5, and the steam treatment stage is followed by an alkaline liquor filling stage, displacing chelated material prior to the cooking rip stage.

According to another embodiment of the present invention, chelant is added to lignocellulosic material separately or in the steam flow in an associated steam treatment treatment in an early stage of a batch pulping process, at a desired steam temperature, during a time sufficient for reaching an end pH of below about 5, and the steam treatment stage is followed by an alkaline liquor filling stage and a subsequent draining stage, whereby chelated material is removed from the cellulosic material prior to the cooking stage.

According to another embodiment of the present invention, chelant is added to lignocellulosic material separately or in the steam flow in an associated steam treatment treatment in an early stage of a batch pulping process, at a desired steam temperature in a vessel outside the digester, during a time sufficient for reaching an end pH of below about 5, and the steam treatment stage is followed by impregnation and displacement of the impregnation liquor containing essentially all of the chelated material prior to the cooking stage. Impregnation means a first immersion of the lignocellulosic material in liquor, whereby a liquor-to-wood ratio of about 2 to about 6 is typically employed.

According to another embodiment of the present invention, the transition from the chelating stage to alkaline delignification conditions is carried out by introducing washing liquid and subsequently removing the washing liquid by introducing alkaline process liquid. In this context, washing liquid means any available aqueous medium, e.g. water, condensate or bleach plant filtrate.

According to another embodiment of the present invention, chelant is added to lignocellulosic material separately or in a flow of reused steam in an associated steam treatment treatment in an early stage of a batch pulping process, at a desired steam temperature, preferably from about 95 to about 170° C., during a time sufficient for reaching an end pH below about 5.

The reused steam may be flashed steam of liquors being depressurized, stripping steam or steam from any other suitable plant source.

Chelant addition may take place directly into the steam flow, or by separate spraying, whereby the order of addition of steam and chelant may vary.

In processes according to the present invention, the lignocellulosic material is chelated prior to delignification in a more or less closed-cycle pulping process. In practice, nonprocess compounds, as metals and in some cases polysaccharide side groups, are transferred into the liquid medium surrounding the lignocellulosic material. Once removed from the fiber, said non-process compounds can be excluded from the process. Expelled liquor is conducted to the plant's recovery facilities, where organic compounds will be combusted and metals will be removed as dregs and muds, separated as white and green liquors are filtered before being returned to the pulping process. In the acid chelating stage, metal ions are exchanged to protons and metals forms complexes with the chelating agents; later, following the neutralization stage, the metals are kept in solution by the chelant and the protons will be replaced by sodium, which is the natural cation in the process. The amount of washing in the neutralization stage and the fate of the leaving liquors depend on the pulp mill in question and its liquor handling capacity. It is important to note that the different embodiments enable use of the present invention in a wide variety of situations. The invention is applicable to alkaline batch pulping processes as defined above. These processes include conventional processes as well as those employing the displacement method well known to those skilled in art.

Preferably, the chelant charge is from about 0.1 to about 10 kg/t oven dry wood, more preferably from about 0.5 to about 5 kg/t oven dry wood and most preferably from about 1 to about 3 kg/t oven dry wood. Preferred chelants are diethylene triamine pentaacetic acid (DTPA), ethylene diamine tetraacetic acid (EDTA) and nitriletriacetic acid (NTA). Most preferable are DTPA and EDTA. Commercial 10–50% solutions may be used. The preferable steam temperature is on the range from about 80 to about 185 IC., more preferably from about 95 to about 170° C. The steaming time in combination with the chosen temperature shall be sufficient to achieve a final pH below about 5.

The advantages of a process according to the invention in comparison with prior art methods for metal removal in cooking are substantial. No extra process steps and very little additional equipment are required; thus, investment costs are negligible. At low pH values in steaming as indicated, metals are effectively dissolved. Chelant addition to the steam flow makes is possible to keep the metals, especially transition metals, in solution in the subsequent neutralizing alkaline steps.

A low pH is required especially for removing Ca from wood. Thus, the invention gives a particular advantage in terms of Ca removal. Concentration of chelant can be kept high, as no diluting liquid is required. Chelated material are directly displaced to the evaporation and recovery cycle, and thus the non-process compound load on the fiber line is lowered. The process lowers the chelating requirement in subsequent processes, and less chelant is thereby discharged from subsequent processes into the effluent treatment system than in the case where extensive chelating is employed in, for example, bleaching. This improves the efficiency of effluent treatment and lowers environmental load. Metal chelates are stable in evaporation conditions, and do not cause precipitation on process equipment in evaporation plants.

DESCRIPTION OF A PREFERRED EMBODIMENT

Figure 1:
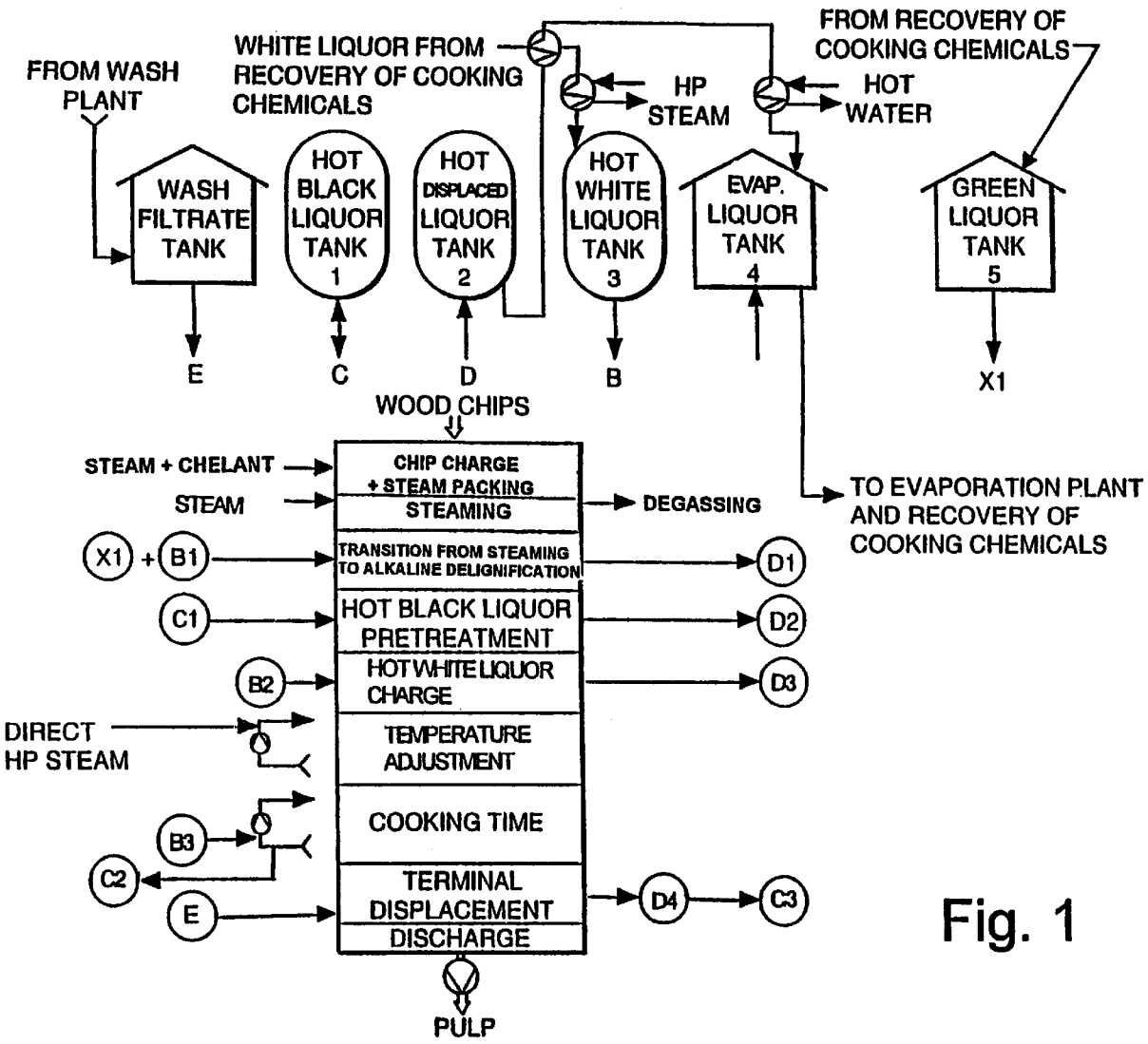
FIG. 1 shows a displacement batch kraft cooking system with pre-steaming and chelant addition.

The invention will be described hereinafter by means of examples demonstrating the effect of chip steaming prior to an industrial batch kraft cooking sequence with and without the addition of chelating agents to the chips. The following abbreviations are used in the examples:

| | |
|---|---|
| EA | Effective alkali = NaOH + ½ $Na_2S$, expressed as NaOH equivalents. |
| HBL | Hot black liquor |
| MP | Medium pressure steam |
| DTPA | Diethylene triamine penta-acetic acid |
| HWL | Hot white liquor |
| WL | White liquor |
| BDT | Brownstock dry tonnes (unbleached pulp) |

EXAMPLE 1

Production of softwood kraft pulp using an industrial kraft displacement batch digester, without the use of chelants. The procedure corresponds to that represented by FIG. 1, with the exception of chelant addition, and indices in italics correspond to those of the figure.

An industrial batch digester having a capacity of 400 $m^3$ was filled with softwood chips (*Pinus sylvesins and Picea abie*) using chip steam packing, low pressure (LP, 3 bar) steam and air evacuation. After a few minutes into the chip fill, medium pressure (M, 10.5 bar) steam was charged to the bottom of the digester and undesired gases were evacuated from the digester. After chip filling, the top valve was closed and the temperature in the digester was increased with MP steam to 140° C. The temperature was held at 140° C. for 15 minutes. Degassing (Al) was carried out through condensers connected to the turpentine recovery. After the desired pressure time, white liquor (Bl, WL, 65 m3, 125 g EA(NaOH)/l; Sulfidity 40%) charge was introduced to the bottom of the digester. Following the white liquor fill, hot spent black liquor was introduced (Cl, HBL, 15 g EA(NaOH)/l) to the bottom of the digester, displacing the steam condensate and liquor from the top of the digester (D2). The contents of the digester were neutralized, as the pre-steaming stage renders the chips acidic because wood acidity is liberated during pre-steaming and steam chip packing. After the hot black liquor stage, hot white liquor (B2, HVL, 125 g EA(NaOH)/l ; sulfidity 40%) charge was introduced to the bottom of the digester, displacing the corresponding volume of spent neutralization white liquor and spent hot black liquor from the digester (D3). A heating stage with circulation and direct steam heating raised the temperature to the cooking temperature of 170° C. A white liquor split charge (B3, HWL, 125 g EA (NaOH)/l) at H-factor 400 was introduced to the digester, displacing a corresponding volume (C2) of spent black liquor. After the desired cooking time, the target H-factor being achieved, the digester was cooled by introducing displacement liquor (E, DPL, 8 g EA(NaOH)/l) into the digester bottom displacing two portions (D4 and C3) of spent black liquor out of the digester top to two separate black liquor accumulators (tanks 1 and 2). After the final displacement the pulp was discharged from the digester using a pump to the discharge tank for further processing.

The hot black liquor tank 2 provided cooled evaporation liquor to tank 4, transferring its heat to white liquor and water by means of heat exchange. Thus, the liquor from hot black liquor tank 2 was sent to evaporation through tank 2 and 4.

Pulp was sampled from the second pulp washing equipment subsequent to cooking and deirotting, and analyzed for metals and pulp properties. Black liquor displaced from the digester and black liquor going to the evaporation plant were analyzed for metals. Cooking characteristics and analysis results are given in Table E1.1.

TABLE E1.1

| Cooking characteristics and analysis results | |
|---|---|
| Cooking | |
| White liquor charge ($m^3$) | 110 |
| H-factor | 1120 |
| Cooking residual (g EA (NaOH)/l) | 18 |
| Unbleached pulp from second washer | |
| Kappa Number | 22 |
| Viscosity (ml/g) | 990 |
| ISO Brightness (%) | 30 |
| Calcium | |
| Pulp + liquor (g/BDT at 10% pulp consistency) | 2063 |
| Manganese | |
| Pulp + liquor (g/BDT at 10% pulp consistency) | 143 |

TABLE E1.1-continued

| Cooking characteristics and analysis results | |
|---|---|
| Displaced black liquor from digester during HBL and HWL fill (mixture of D2 and D3) | |
| Calcium (mg/kg dry solid) | 295 |
| Manganese (mg/kg dry solid) | 71 |
| Evaporation black liquor (from tank 4) | |
| Calcium (mg/kg dry solid) | 192 |
| Manganese (mg/kg dry solid) | 80 |

EXAMPLE 2

Production of softwood kraft pulp using an industrial kraft displacement batch digester and chelant charge during chip steam filling The cook was carried out as disclosed in Example 1, but with the following exception: A DTPA water solution (concentration 40%) was charged with a pump to the packing steam used during the chip fill. The DTPA charge was 4 kg/tons of wood (air dry basis). The temperature was increased to 135° C. with MP steam. The hot black liquor tank 2 provided cooled evaporation liquor to tank 4, transferring heat to white liquor and water by means of heat exchange. Thus, the displaced chelated medium was sent to evaporation through tank 2 and 4. The use of chelating agent did not essentially increase the load on the evaporation function within the plant. FIG. 1 illustrates the procedure of Example 2.

Improved results with respect to reference example 1 are given in Table E2.1.

TABLE E2.1

| Cooking characteristics and analysis results | |
|---|---|
| Cooking | |
| White liquor charge ($m^3$) | 112 |
| H-factor | 1130 |
| Cooking residual (g EA (NaOH)/l) | 18 |
| Unbleached pulp from second washer | |
| Kappa Number | 19 |
| Viscosity (ml/g) | 1030 |
| ISO Brightness (%) | 33 |
| Calcium | |
| Pulp + liquor (g/BDT at 12% pulp consistency) | 1692 |
| Manganese | |
| Pulp + liquor (g/BDT at 12% pulp consistency) | 57 |
| Displaced black liquor from digester during HBT and HWL fill fill (mixture of D2 and D3) | |
| Calcium (mg/kg dry solid) | 731 |
| Manganese (mg/kg dry solid) | 160 |
| Evaporation black liquor from tank 4 | |
| Calcium (mg/kg dry solid) | 338 |
| Manganese (mg/kg dry solid) | 114 |

Example 1 demonstrates the results from a displacement kraft batch cook of softwood, thus representing a state-of-the-art cooking process. In the steaming stage, acidity was liberated from the wood. In these acid conditions, metals were liberated from the wood. However, during the subsequent addition of alkaline cooking liquors, the metals were resorbed on the wood and as can be seen, the pulp contained considerable amounts of non-process compounds, thus increasing manufacturing costs and diminishing the possibilities for closed circulation pulp production.

Example 2 demonstrates the result when a process according to the present invention is carried out on softwood The amount of non-process compounds in the unbleached pulp was significantly lowered when a chelating stage was carried out during the chip steam packing stage. In the steaming stage, acidity is liberated from the wood, liberating metals as described above. In the following stage, when introducing alkaline cooking liquor from the bottom of the digester, the chelant keep the dissolved metals in solution. Thus, the metals are displaced from the digester and can be conveyed to the evaporation plant and the recovery cycle, where the metals can be removed from the process in dregs.

What is claimed is:

1. A process for preparing pulp from a lignocellulosic material that contains metal contamination comprising:

(a) providing said cellulosic material in a zone containing a chelating agent and steam at a pH below about 5 wherein said metal contamination is chelated, (b) introducing a liquor into said zone with the dissolution of the metal chelates formed in (a), (c) removing said liquor containing the dissolved metal chelates from said zone, and (d) alkaline delignifying the remaining cellulosic material.

2. A process for preparing pulp according to claim 1 wherein said cellulosic material is preliminarily contacted with steam apart from the zone in which chelation takes place.

3. A process for preparing pulp according to claim 2 wherein said chelating agent and said steam are together introduced into said zone.

4. A process for preparing pulp according to claim 2 herein said chelating agent and said steam are separately introduced into said zone.

5. A process for preparing pulp according to claim 2 wherein (a) is carried out at a temperature of about 80 to 185° C.

6. A process for preparing pulp according to claim 2 wherein (a) is carried out at a temperature of about 95 to 170° C.

7. A process for preparing pulp according to claim 2 wherein said cellulosic material is wood and said chelating agent is provided in a concentration of about 0.1 to 10 kg/t of oven dry wood.

8. A process for preparing pulp according to claim 2 wherein said cellulosic material is wood and said chelating agent is provided in a concentration of about 0.5 to 5 kg/t of oven dry wood.

9. A process for preparing pulp according to claim 2 wherein said cellulosic material is wood and said chelating agent is provided in a concentration of about 1 to 3 kg/t of oven dry wood.

10. A process for preparing pulp according to claim 1 wherein said chelating agent and said steam are together introduced into said zone.

11. A process for preparing pulp according to claim 10 wherein (a) is carried out at a temperature of about 80 to 185° C.

12. A process for preparing pulp according to claim 10 wherein (a) is carried out at a temperature of about 95 to 170° C.

13. A process for preparing pulp according to claim 10 wherein said cellulosic material is wood and said chelating agent is provided in a concentration of about 0.1 to 10 kg/t of oven dry wood.

14. A process for preparing pulp according to claim 10 wherein said cellulosic material is wood and said chelating agent is provided in a concentration of about 0.5 to 5 kg/t of oven dry wood.

15. A process for preparing pulp according to claim 1 wherein said chelating agent and said steam are separately introduced into said zone.

16. A process for preparing pulp according to claim 1 wherein (a) is carried out at a temperature of about 80 to 185° C.

17. A process for preparing pulp according to claim 16 wherein said cellulosic material is wood and said chelating agent is provided in a concentration of about 0.1 to 10 kg/t of oven dry wood.

18. A process for preparing pulp according to claim 16 wherein said cellulosic material is wood and said chelating agent is provided in a concentration of about 0.5 to 5 kg/t of oven dry wood.

19. A process for preparing pulp according to claim 16 wherein said cellulosic material is wood and said chelating agent is provided in a concentration of about 1 to 3 kg/t of oven dry wood.

20. A process for preparing pulp according to claim 1 wherein (a) is carried out at a temperature of about 95 to 170° C.

21. A process for preparing pulp according to claim 20 wherein said cellulosic material is wood and said chelating agent is provided in a concentration of about 1 to 3 kg/t of oven dry wood.

22. A process for preparing pulp according to claim 1 wherein said cellulosic material is wood and said chelating agent is provided in a concentration of about 0.1 to 10 kg/t of oven dry wood.

23. A process for preparing pulp according to claim 1 wherein said cellulosic material is wood and said chelating agent is provided in a concentration of about 0.5 to 5 kg/t of oven dry wood.

24. A process for preparing pulp according to claim 1 wherein said cellulosic material is wood and said chelating agent is provided in a concentration of about 1 to 3 kg/t of oven dry wood.

* * * * *